United States Patent [19]

Leopoldi et al.

[11] 4,281,527

[45] Aug. 4, 1981

[54] KEY HOLDER

[76] Inventors: Norbert Leopoldi, 3601 W. Devon Ave., Chicago, Ill. 60659; William P. Heinrich, 2709 W. Sterling Dr., McHenry, Ill. 60050

[21] Appl. No.: 99,077

[22] Filed: Nov. 30, 1979

Related U.S. Application Data

[63] Continuation-in-part of Ser. No. 60,495, Jul. 25, 1979, abandoned.

[51] Int. Cl.[3] ..... A47G 29/10

[52] U.S. Cl. ..... 70/456 R

[58] Field of Search ..... 70/456 R, 459, 456 B; 24/3 K; 150/40

[56] References Cited

U.S. PATENT DOCUMENTS

| | | | |
|---|---|---|---|
| 2,605,632 | 8/1952 | Lamonde | 70/456 R |
| 3,175,380 | 3/1965 | Ward | 70/456 R |

*Primary Examiner*—Robert L. Wolfe

[57] ABSTRACT

A key holder is provided consisting of an open-ended housing, a tray slidably disposed within the housing and a resilient wire bail, slidably disposed on the housing and attached to the tray so as to move in unison with the tray as the tray is moved into and out of the housing. The bail is detached from the housing and tray and is threaded through the holes of a number of keys. The bail, with the keys mounted thereon, is then attached to the tray and housing by spreading the legs of the resilient bail and inserting dogs formed at the ends of the legs through slots in the sides of the housing and into sockets in the tray. As the tray is slipped into the housing, the bits of the keys are inserted into the housing as well. When the use of a key is desired, the keys, bail and tray are partially pulled from the housing. The key to be used is then rotated away from the housing and the remaining keys may then be reinserted. As an alternative embodiment the device may be constructed of two pieces, an open ended housing and a wire bail, without the need for a sliding tray.

3 Claims, 8 Drawing Figures

KEY HOLDER

CROSS REFERENCE TO RELATED APPLICATION

This application is a continuation-in-part of application for U.S. patent Ser. No. 60,495 filed July 25, 1979, now abandoned.

BACKGROUND OF THE INVENTION

This invention relates to new and useful improvements in a device for holding keys in one's pocket or purse. In the prior art are several simple arrangements such as key chains, key rings and key cases which present many disadvantages in their use. Key cases are bulky and must be unsnapped and opened before selecting a key for use. Key chains are disorganized in that the keys are randomly and loosely arranged. The keys are exposed and, when carried in a pants pocket, the sharp keys may cause discomfort and demage to clothing. Key rings present both disadvantages: exposed, randomly arranged keys and a bulky configuration.

SUMMARY OF THE INVENTION

The present invention comprises a new and improved holder for keys to be carried in pocket, purse or otherwise. The device comprises an open-ended housing of plastic or similar material, a plastic tray slidably disposed within the housing, and a bail, formed of metal wire and attached to the tray. The bail is attached to the tray by spreading the bail's legs and then inserting dogs or protuberances formed at the ends of the bail's legs through slots in the key holder's housing and into sockets in the tray. The tray and the bail are then free to slide in unison with respect to the housing.

Keys are carried on the bail, which is threaded through the holes in the keys prior to its attachment to the holder. When the tray and bail are slid into the housing, the bits of the keys are encased by the housing and tray. By pulling the keys, bail and tray out of the housing, one of the keys may be selected for use and the others reinserted into the housing.

In an alternative embodiment of the invention, the key holder consists of two pieces, the hollow open ended housing and a wire bail. The bail is attached to the tray by squeezing the legs of the bail and inserting them into the housing. The bail's legs are then released so that outwardly protruding dogs at the end of each leg engage slots in the sides of the housing. The bail is then free to slide into and out of the housing.

DESCRIPTION OF THE PREFERRED EMBODIMENT

Figure 1:
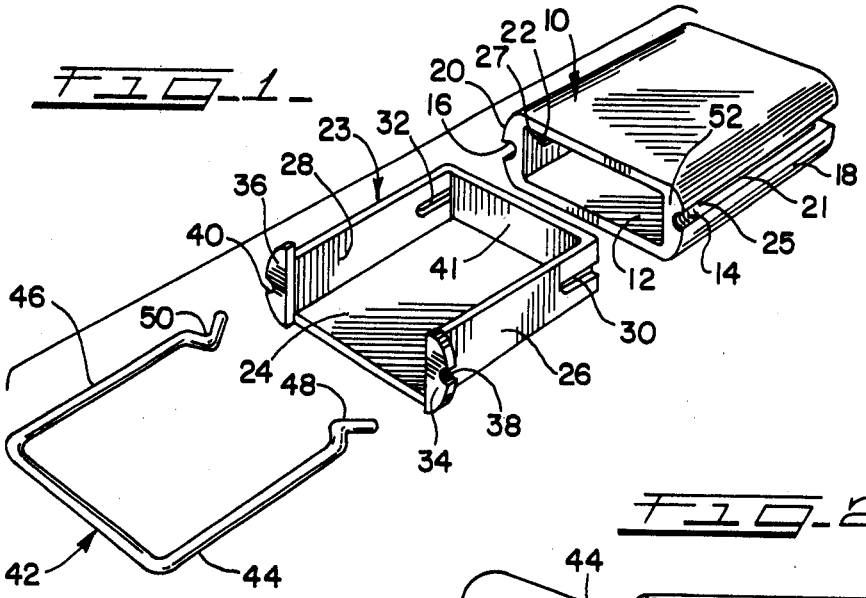
FIG. 1 is an exploded view of the preferred embodiment of the key holder.
Figure 4:
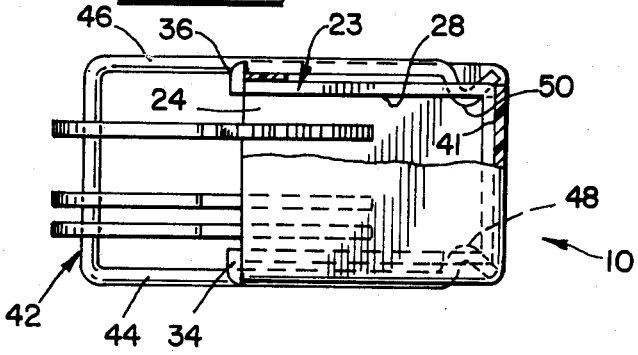
FIG. 4 is a top elevation partially broken away of the preferred embodiment fully closed, with keys.
Figure 5:
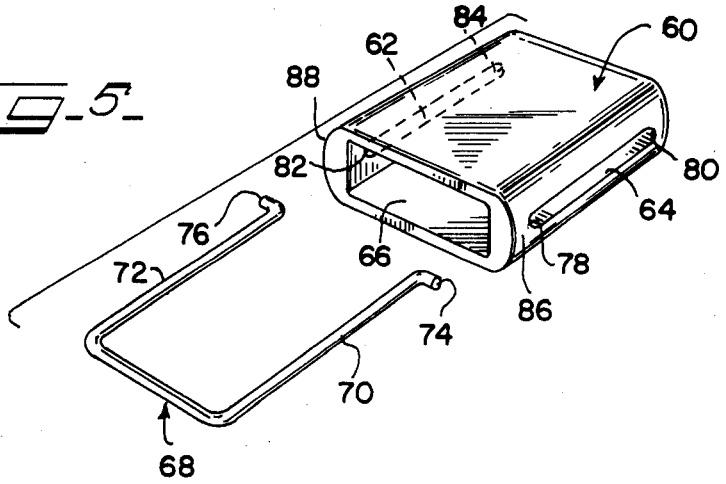
FIG. 5 is an exploded view of the alternative embodiment of the key holder.

Turning now to the drawings, there is shown in FIGS. 1 and 4 a housing 10 of plastic or similar material. The housing includes a mouth 12 at one end and grooves 14 and 16 on the rounded sides 18 and 20, running the length of the housing 10. Slots 21 and 22 are located in grooves 14 and 16, respectively, running from abutments 25 and 27 to the closed end of the housing.

Tray 23 may be formed of the same type of material as housing 10. Base 24 of tray 23 is flanked by sides 26 and 28, in which are located sockets 30 and 32. Flanges 34 and 36 are located at one end of tray 23, projecting from sides 26 and 28 respectively. Notches 38 and 40 are located in flanges 34 and 36, corresponding to grooves 14 and 16. At the opposite end of tray 23 is end plate 41.

Bail 42 is formed of a material such as 0.1 inch diameter spring steel wire that will return to its original shape after being deformed outwardly. Dogs or protuberances, 48 and 50 point inwardly from the ends of legs 44 and 46, respectively.

In use, bail 42 is threaded through the holes in the keys to be carried. The tray 23 is inserted into the mouth 12 of housing 10. Legs 44 and 46 of bail 42 are spread sufficiently to clear the width of housing 10. Dogs, or protuberances, 48 and 50 are then inserted through slots 21 and 22 and into sockets 30 and 32, respectively. Legs 44 and 46 engage notches 38 and 40 and grooves 14 and 16, respectively.

In operation, the bail 42 and tray 23 slide, in unison, into and out of housing 10. The range of such movement is limited, inwardly, by the abutting of flanges 34 and 36 against housing face 52, and outwardly, by the contact of dogs 48 and 50 with abutments 25 and 27 at the ends of slots 21 and 22.

Figure 2:
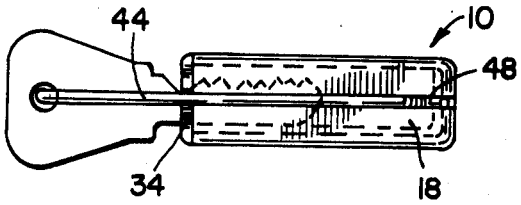
FIG. 2 is a side elevation of the preferred embodiment fully closed, with keys.
Figure 3:
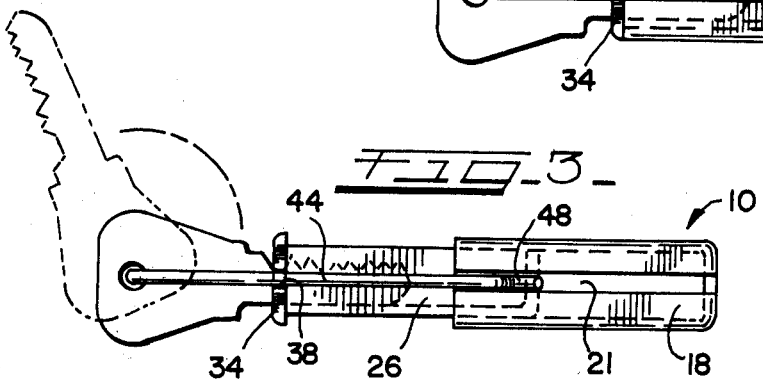
FIG. 3 is a side elevation of the preferred embodiment fully extended, with keys.

With the bail and tray pulled from the housing, so that dogs 48 and 50 contact abutments 25 and 27, respectively, as shown in FIG. 3, any of the keys may be selected for use and rotated away from the housing. The remaining keys are then aligned on the tray so that they may be inserted into the housing by sliding the bail and tray into the housing until flanges 34 and 36 abut housing face 52. All of the keys may be inserted into the holder for carrying, as shown in FIG. 2. In this configuration the arrangement presents a very compact unit. None of the points, or teeth, of the keys is exposed to tear or tangle clothing or other items carried in one's pocket or purse.

This device may be useful as an advertising premium. Logos, trademarks, tradenames and other advertising material may be displayed on either the body or the tray of the key holder.

DESCRIPTION FO THE ALTERNATIVE EMBODIMENT

An alternative embodiment of the present invention is shown in FIGS. 5 through 8. A hollow open ended housing 60 is provided made of plastic or similar material. The housing includes a mouth 66 at one end and slots 62 and 64 in the rounded sides 88 and 86, respectively. Slot 62 runs from abutment 82 to abutment 84 and slot 64 runs from abutment 78 to abutment 80.

Bail 68 is formed of a material such as 0.1 inch diameter spring steel wire which will return to its original shape after being deformed inwardly. Dogs 74 and 76 point outwardly from the ends of legs 70 and 72, respectively.

In use, bail 68 is threaded through the holes in the keys to be carried. Legs 70 and 72 are squeezed together sufficiently so that the distance between the ends of dogs 74 and 76 is less than the interior width of mouth 66. The legs of the bail are inserted into housing 60 through mouth 66. Legs 70 and 72 are then released so that dogs 74 and 76 engage slots 64 and 62, respectively.

The bail 68 slides into and out of housing 60. The range of such movement is limited inwardly by the contact of dogs 74 and 76 against abutments 80 and 84, respectively, and outwardly by the contact of dogs 74 and 76 with abutments 78 and 82, respectively.

Figure 6:
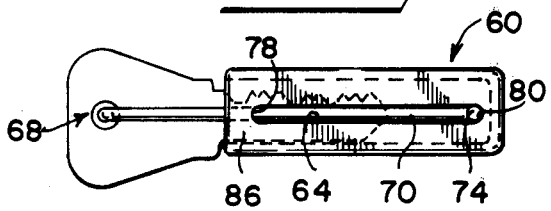
FIG. 6 is a side elevation of the alternative embodiment fully closed, with keys.
Figure 7:
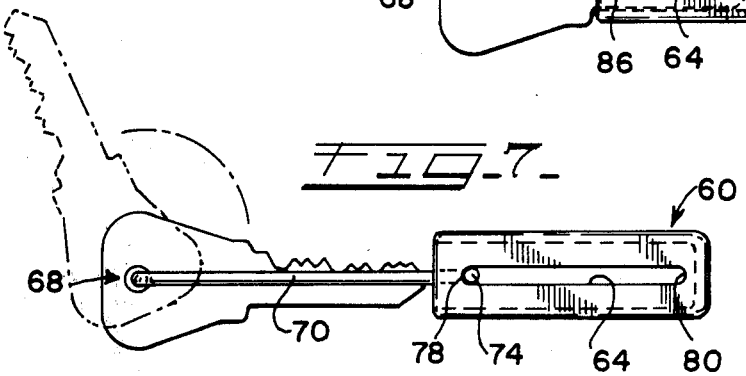
FIG. 7 is a side elevation of the alternative embodiment fully extended, with keys.
Figure 8:
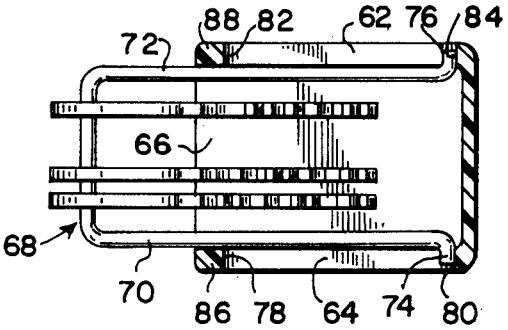
FIG. 8 is a top elevation broken away of the alternative embodiment fully closed, with keys.

With the bail pulled from the housing so that dogs 74 and 76 contact abutments 78 and 82, respectively, as shown in FIG. 7 any of the keys may be selected for use and rotated away from the housing. The remaining keys are then reinserted into the housing by sliding the bail into the housing until dogs 74 and 76 contact abutments 80 and 84. All of the keys may be inserted into the holder for carrying as shown in FIG. 6. This configuration is even lighter in weight than the preferred embodiment since there is no alignment tray.

What is claimed is:

1. An apparatus for holding keys comprising a housing, open at one end, a resilient, generally U-shaped bail, slidably disposed on said housing, wherein said housing is adapted to receive and retain the bits of a plurality of keys and a means for aligning said keys for insertion in the said housing comprising a tray, slidably disposed within said housing, mounted for movement in unison with said bail.

2. An apparatus as in claim 1 wherein said bail is formed into a configuration comprising a cross-piece, two legs and a dog facing inwardly at the end of each of said legs, said dogs adapted to engage longitudinal slots in said housing.

3. An apparatus as in claim 1 wherein said bail is formed into a configuration comprising a cross-piece, two legs and a dog facing outwardly at the end of each of said legs, said dogs adapted to engage longitudinal slots in said housing.

* * * * *